US009326074B2

(12) United States Patent
Jiles

(10) Patent No.: US 9,326,074 B2
(45) Date of Patent: Apr. 26, 2016

(54) INCREASED COMPLIANCE FLAT REED TRANSDUCER

(71) Applicant: Knowles Electronics, LLC, Itasca, IL (US)

(72) Inventor: Mekell Jiles, Flossmoor, IL (US)

(73) Assignee: KNOWLES ELECTRONICS, LLC, Itasca, IL (US)

( * ) Notice: Subject to any disclaimer, the term of this patent is extended or adjusted under 35 U.S.C. 154(b) by 0 days.

(21) Appl. No.: 14/490,225

(22) Filed: Sep. 18, 2014

(65) Prior Publication Data

US 2015/0086049 A1 Mar. 26, 2015

Related U.S. Application Data

(60) Provisional application No. 61/881,646, filed on Sep. 24, 2013.

(51) Int. Cl.
*H04R 25/00* (2006.01)
*H04R 11/04* (2006.01)
*H04R 11/08* (2006.01)

(52) U.S. Cl.
CPC ..... *H04R 11/04* (2013.01); *H04R 11/08* (2013.01)

(58) Field of Classification Search
CPC ..... H04R 11/02; H04R 11/00; H04R 1/08
USPC ..... 381/176, 417, 418, 162, 186, 322, 398, 381/386, 370
See application file for complete search history.

(56) References Cited

U.S. PATENT DOCUMENTS

| | | | | |
|---|---|---|---|---|
| 3,935,398 | A | 1/1976 | Carlson | |
| 4,473,722 | A | 9/1984 | Wilton | |
| 5,101,435 | A | 3/1992 | Carlson | |
| 5,610,989 | A | 3/1997 | Salvage | |
| 5,647,013 | A | 7/1997 | Salvage | |
| 5,708,721 | A | 1/1998 | Salvage | |
| 6,041,131 | A | 3/2000 | Kirchhoefer | |
| 6,654,477 | B1 * | 11/2003 | Miller | H04R 11/00 381/397 |
| 7,050,602 | B2 | 5/2006 | Miller | |
| 7,103,196 | B2 | 9/2006 | Warren | |
| 7,164,776 | B2 | 1/2007 | Miller | |
| 7,203,334 | B2 | 4/2007 | Schafer | |

(Continued)

FOREIGN PATENT DOCUMENTS

JP 03-073099 U 7/1991

OTHER PUBLICATIONS

International Search Report and Written Opinion for PCT/US2014/056725 dated Dec. 23, 2014 (9 pages).

*Primary Examiner* — Brian Ensey
*Assistant Examiner* — Julie X Dang
(74) *Attorney, Agent, or Firm* — Fitch, Even, Tabin & Flannery LLP

(57) ABSTRACT

A receiver, the receiver includes a coil, a top assembly, a bottom assembly, and a flat planar armature. The flat planar armature includes an outer ring-like portion that forms a first opening. The flat planar armature further includes a central portion that extends from the outer ring-like portion into the opening. An end of the central portion is free to move in the presence of magnetic flux. The flat planar armature has a first end portion and a second end portion. The first end portion couples to the top assembly and the bottom assembly. The top assembly and the bottom assembly form a second opening that exposes the second end portion.

7 Claims, 2 Drawing Sheets

(56) References Cited

U.S. PATENT DOCUMENTS

| | | | |
|---|---|---|---|
| 7,236,609 | B1 | 6/2007 | Tsangaris |
| 7,336,797 | B2 | 2/2008 | Thompson |
| 7,362,878 | B2 | 4/2008 | Miller |
| 7,366,317 | B2 | 4/2008 | Miller |
| 7,415,125 | B2 | 8/2008 | Warren |
| 7,443,997 | B2 | 10/2008 | Miller |
| 7,817,815 | B2 | 10/2010 | Miller |
| 7,860,264 | B2 | 12/2010 | Jiles |
| 7,921,540 | B2 | 4/2011 | Jiles |
| 7,925,041 | B2 | 4/2011 | Jiles |
| 7,995,789 | B2 | 8/2011 | Tsangaris |
| 8,027,492 | B2 | 9/2011 | Miller |
| 8,233,646 | B2 | 7/2012 | Lutz |
| 8,284,964 | B2 | 10/2012 | Windischberger |
| 8,494,209 | B2 | 7/2013 | Miller |
| 8,824,726 | B2 | 9/2014 | Miller |
| 8,837,755 | B2 | 9/2014 | Jiles |
| 9,137,605 | B2 | 9/2015 | Manley |
| 9,137,610 | B2 | 9/2015 | Jiles |
| 2002/0003890 | A1 | 1/2002 | Warren |
| 2002/0074995 | A1* | 6/2002 | Spellman ..... G01P 3/488 324/207.15 |
| 2003/0021454 | A1* | 1/2003 | Weyl ..... G06T 1/0007 382/128 |
| 2003/0021458 | A1* | 1/2003 | Hamada ..... B06B 1/0603 382/135 |
| 2005/0152574 | A1 | 7/2005 | Van Banning et al. |
| 2007/0036378 | A1 | 2/2007 | Saltykov |
| 2008/0205691 | A1 | 8/2008 | Beekman et al. |
| 2008/0226115 | A1* | 9/2008 | Beekman ..... H04R 11/02 381/417 |
| 2009/0147983 | A1 | 6/2009 | Jiles |
| 2012/0008804 | A1 | 1/2012 | Bedwell et al. |
| 2015/0110338 | A1 | 4/2015 | McCratic |

* cited by examiner

INCREASED COMPLIANCE FLAT REED TRANSDUCER

CROSS REFERENCE TO RELATED APPLICATION

This patent claims benefit under 35 U.S.C. §119 (e) to U.S. Provisional Application No. 61/881,646 entitled "Increased Compliance Flat Reed Transducer" filed Sep. 24, 2013, the content of which is incorporated herein by reference in its entirety.

TECHNICAL FIELD

This disclosure relates to acoustic devices and, more specifically, to reeds or armatures used in these devices.

BACKGROUND

Various types of microphones and receivers have been used through the years. In these devices, different electrical components are housed together within a housing or assembly. For example, a receiver typically includes a coil, bobbin, stack, among other components and these components are housed within the receiver housing. Other types of acoustic devices may include other types of components.

Generally speaking, a receiver motor typically includes a coil, a yoke, an armature, and magnets. An electrical signal applied to the coil creates a magnetic field within the motor which causes the armature to move. The armature, sometimes referred to as a reed, forms a part of the magnetic circuit. The armature is coupled to a diaphragm. The moving diaphragm produces sound and this sound is presented to a user.

As mentioned, a receiver typical includes a reed or armature. The reed, in some instances, may be U-shaped (in the cross section). In other cases, the reed may be E-shaped and generally flat (in the cross section). In some aspects and circumstances, the E-shaped flat design yields a better performance than U-shaped armatures. Unfortunately, the E-shaped flat design also tends to be stiffer because it is often much shorter than the curved U-shaped armature. The stiffness may in effect negate at least some of the benefits of the E-shaped flat design. This has led to some user dissatisfaction with these previous approaches and has sometimes limited the usage of E-shaped armatures in receivers.

BRIEF DESCRIPTION OF THE DRAWINGS

For a more complete understanding of the disclosure, reference should be made to the following detailed description and accompanying drawings wherein.

Figure 1:
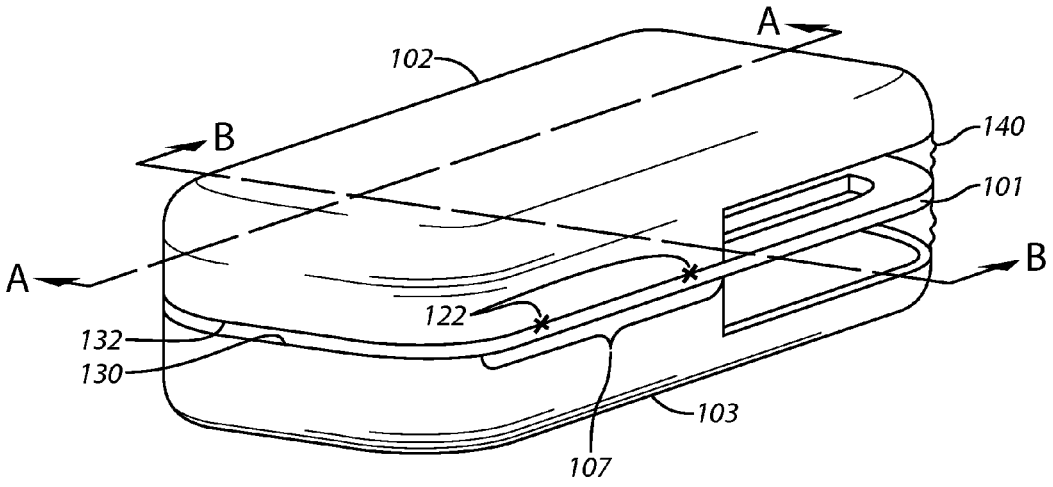
FIG. 1 is a perspective view of a receiver with an E-shaped armature.

Those of ordinary skill in the art will appreciate that elements in the figures are illustrated for simplicity and clarity. It will be appreciated further that certain actions and/or steps may be described or depicted in a particular order of occurrence while those of ordinary skill in the art will understand that such specificity with respect to sequence is not actually required. It will also be understood that the terms and expressions used herein have the ordinary meaning as is accorded to such terms and expressions with respect to their corresponding respective areas of inquiry and study except where specific meanings have otherwise been set forth herein.

DETAILED DESCRIPTION

Referring now to FIG. 1, FIG. 2, FIG. 3, and FIG. 4 one example of a receiver 100 having a flat reed 101 or armature is described. It will be appreciated that although the armatures and reeds described herein are generally E-shaped, other non-E-shaped designs can also be employed.

The flat reed 101 is enclosed in a top assembly (or housing) 102 and a bottom assembly (or housing) 103. The reed 101 has an outer member 104 and a central member 108. The central member 108 of the reed 101 is disposed in a tunnel 105 between a coil 116 and magnets 118. A portion of the outer member 104 is in contact with and welded (or otherwise attached) to the top assembly 102 and the bottom assembly 103 as is a front portion 107 of the reed 101. As mentioned, welds can be used to secure the elements together. However, other attachment mechanisms such as using glues or other adhesives may also be used.

The magnets 118 may include a stack assembly that is created with a suitable material for a magnetic flux flow to be maintained. Both the magnets 118 may be attached (via any suitable attachment mechanism) to the top assembly 102 and to the bottom assembly 103.

Figure 2:
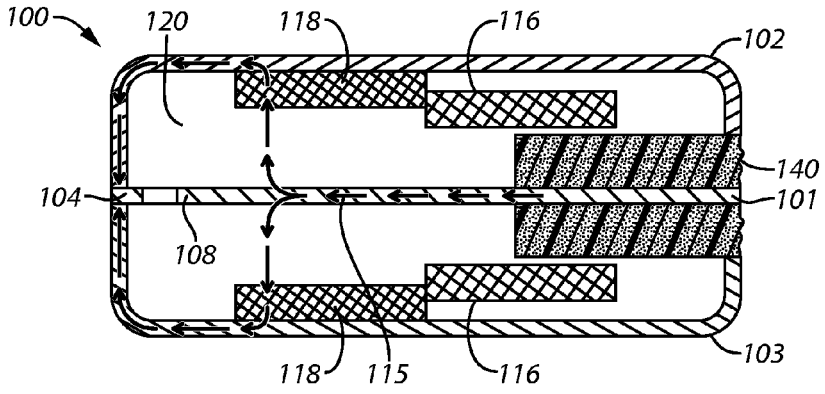
FIG. 2 is a cross-sectional view taken along line A-A of the receiver of FIG. 1.

In operation, a flux is introduced through the coil 116, the central member 108 of the reed 101 moves, and this moves a rod (not shown in the figures) that is attached to a diaphragm thereby moving the diaphragm (also not shown in the figures) producing sound energy that can be presented to a user at a port (also not shown in the figures). A magnetic flux path 115 is created as shown in FIG. 2. The flux path 115 (forming a magnetic circuit) extends through the magnets 118 (including a stack assembly) through the assemblies 102 and 103, and then is completed by flowing through the central member 108 of the reed 101.

Figure 3:
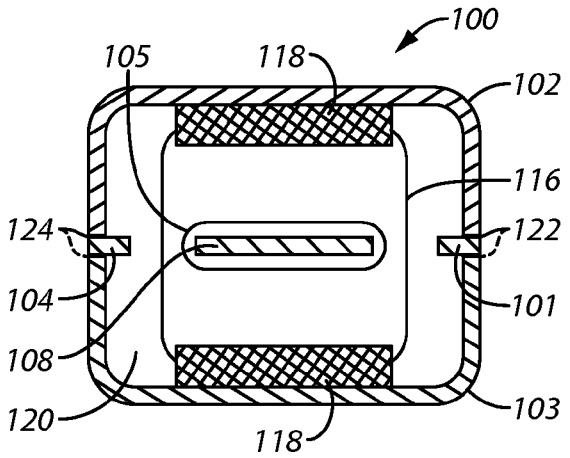
FIG. 3 is a cross-sectional view taken along line B-B of the receiver of FIG. 1.
Figure 4:
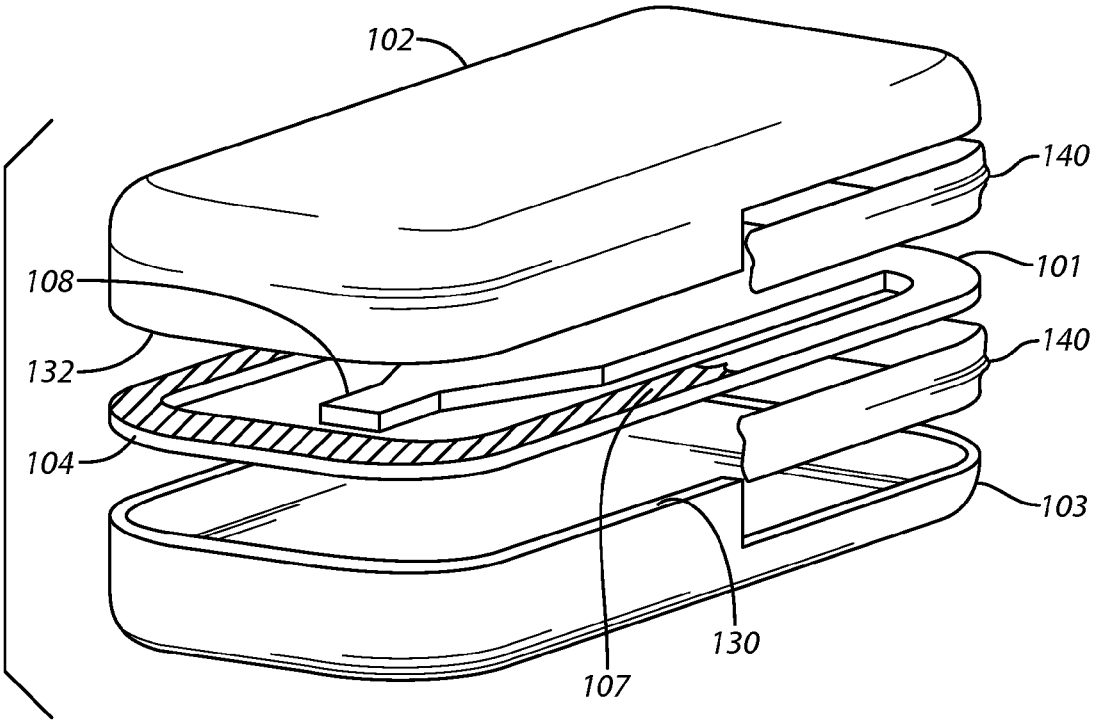
FIG. 4 is an exploded perspective view of the receiver of FIG. 1.

Looking at an end view shown in FIG. 3, if A is the cross section area of the central member 108, B is the cross-sectional area of the outer member 104 then in one case A=B and in another case A<B. However, it cannot be the case that A>B. This is because a certain amount of flux flows through A and this cannot be more than the total amounts that can flow through B. If this were the case, then performance problems could develop in the receiver 100 because more flux would be entering the area B than could be handled in effect creating a flux bottleneck.

It can be seen that the end of the central member 108 of the reed 101 can freely move. The top assembly 102 and the bottom assembly 103 include a stepped shaped mating edge and this forms a volume 120. A low modulus elastomer or formed annulus 140 may be used to create a seal and fill the volume 120 while still allowing the central member 108 of the reed 101 to move. This approach allows the reed to move, greatly increases the effective length of the reed, and increases reed compliance.

Weld locations 122 and 124 couple the reed 100 to the housing. The reed 100 mates with the cover/case along surfaces 130 and 132. As shown, the receiver housing that is thereby formed is stepped in configuration.

The approaches described herein provide a flat (non U-shaped reed) with effective lengths that are longer than previous flat reed approaches. The present approaches utilize a stepped cover/cup with a first (rear) portion of the reed remaining unconstrained. By allowing the reed 101 to move, the overall effective length of the reed 101 is increased and the low frequency (LF) sensitivity is increased for a given reed size. As mentioned and in some aspects, the open (rear) section 120 between the reed and the housing could be filled with a low modulus material (e.g., silicon, low modulus epoxy). This allows the case of the receiver 100 to be sealed, but will add only a portion of the stiffness of the case back to the receiver 100.

The dimensions of the various elements described herein can vary. For example, the thickness of the reed 101 can, in one example, be approximately 0.0005 inches. The width of each side of the outer member 104 can be approximately 0.0030 inches while the length can be approximately 0.120 inches. The width of the central member 108 can be approximately 0.060 inches. It will be appreciated that these are example dimensions only and that other dimensions are possible. The overall length of the reed 101 is approximately 0.120 inches.

As mentioned, the examples of reeds described herein are generally E-shaped and flat in design. However, it will be appreciated that other configures are possible.

Preferred embodiments of the disclosure are described herein, including the best mode known to the inventors. It should be understood that the illustrated embodiments are exemplary only, and should not be taken as limiting the scope of the appended claims.

What is claimed is:

1. A receiver, the receiver comprising:

a coil;

a top assembly;

a bottom assembly;

a one-piece flat planar armature, the one-piece flat planar armature including an outer ring-like portion that forms a first opening, the one-piece flat planar armature further including a central portion that extends from and is contiguous with the outer ring-like portion into the opening, an end of the central portion being free to move in the presence of magnetic flux, wherein the one-piece flat planar armature has a first end portion that includes the end of the central portion that is free to move, and a second end portion that includes the portion where the central portion is contiguous with the outer ring-like portion;

wherein the first end portion couples to the top assembly and the bottom assembly at the outer ring-like portion;

wherein the top assembly and the bottom assembly form a second opening that exposes the second end portion, the second end portion not being connected to the top assembly or the bottom assembly, the second opening extending across an entire width of the receiver.

2. The receiver of claim 1, wherein the second opening is at least partially filled with a filler that is more compliant than the top assembly and bottom assembly.

3. The receiver of claim 2, wherein the filler comprises a low modulus elastomer.

4. The receiver of claim 1, wherein the filler comprises a formed annulus.

5. The receiver of claim 1, wherein the one-piece flat planar armature is E-shaped.

6. The receiver of claim 1, wherein the central portion extends through a tunnel in the coil.

7. The receiver of claim 1, further comprising magnets disposed about the coil.

* * * * *